United States Patent [19]

Braun

[11] 4,094,243

[45] June 13, 1978

[54] DEVICE FOR ADJUSTING FORM ROLLERS PROVIDING AUTOMATIC COMPENSATION FOR CHANGE IN PACKING THICKNESS

[75] Inventor: Rolf Braun, Offenbach, Germany

[73] Assignee: Roland Offsetmaschinenfabrik Faber & Schleicher AG., Germany

[21] Appl. No.: 808,083

[22] Filed: Jun. 20, 1977

[30] Foreign Application Priority Data

Jun. 23, 1976 Germany ..... 2627963

[51] Int. Cl.[2] ..... B41L 27/36

[52] U.S. Cl. ..... 101/349; 101/218

[58] Field of Search ..... 101/349, 350, 352, 206, 101/207, 209, 217, 218, 247, 144

[56] References Cited

U.S. PATENT DOCUMENTS

| | | | |
|---|---|---|---|
| 2,653,537 | 9/1953 | Peyrebrune | 101/352 X |
| 2,853,943 | 9/1958 | Royer | 101/352 X |
| 3,323,452 | 6/1967 | Pasquinelli | 101/352 |
| 3,538,849 | 11/1970 | Bohman | 101/352 |
| 3,691,956 | 9/1972 | James et al. | 101/352 |

FOREIGN PATENT DOCUMENTS

| | | | |
|---|---|---|---|
| 1,207,883 | 2/1960 | France | 101/352 |

*Primary Examiner*—J. Reed Fisher

*Attorney, Agent, or Firm*—Leydig, Voit, Osann, Mayer & Holt, Ltd.

[57] ABSTRACT

A printing press having a plate cylinder and a cooperating cylinder, a layer of packing being interposed under the plate. A film of ink is applied to the plate by a plurality of form rollers. An eccentric bushing is interposed between the plate cylinder and the frame of the press rockable from a reference position to an adjusted position for increasing the spacing between the axes of the plate cylinder and its cooperating cylinder as necessary to accommodate an increase in the thickness of the packing. A cam sector is mounted at the end of the plate cylinder having spirally curved segments for radially supporting the rollers with respect to the plate and mounted for rocking movement for camming the rollers relatively away from the axis of the plate cylinder. The cam sector is rotatively coupled to the eccentric bushing for rocking movement in unison therewith and the spiral slope of each of the curved segments is such that the degree of rocking of the eccentric bushing necessary to accommodate a predetermined increase in packing thickness causes a total outward throw at each of the form rollers equal to the movement of the plate cylinder axis toward the form roller axis plus an amount equal to the added thickness of the packing, with the result that the spacial relationship between the form rollers and the plate is unaffected by a change in the thickness of the packing. In the preferred embodiment the cam sector is fixed to the eccentric bushing. Provision is made for individual adjustment of the radial position of each curved segment.

7 Claims, 7 Drawing Figures

DEVICE FOR ADJUSTING FORM ROLLERS PROVIDING AUTOMATIC COMPENSATION FOR CHANGE IN PACKING THICKNESS

In lithographic, or offset, printing, it is possible to bring about a slight lengthening of the printed image by increasing the thickness of the layer of packing under the printing plate. This may be done to compensate for the lengthening of a sheet which occurs due to moisture absorption or to compensate for different thicknesses of paper. Exact control of printing length is especially necessary when printing on card paper stock and to secure the desired condition of dot register of superimposed images in a multi-color press. The effects achieved by adjusting packing thickness are as discussed in an article entitled "True Rolling of the Cylinders of Offset Presses and the Various Possibilities" which appeared in Roland Nachrichten No. 2 of April, 1956.

Making changes in the thickness of the packing, however, requires a corresponding re-adjustment of the position of the plate cylinder in relation to the blanket cylinder in order to restore desired pressure between the cylinders. Moreover, increasing the packing thickness changes the relationship between the plate and the form rollers so that the form rollers must be re-adjusted as well. In French Pat. No. 1,207,883 a mechanism is described by means of which it is possible to throw the inking form rollers in or out simultaneously with the plate cylinder. This is accomplished by a ring which is mounted at the plate cylinder bearing eccentrically to the plate cylinder and on which the bearings of the form rollers rest. The form rollers in the French patent follow the displacement movement of the plate cylinder, but when the plate cylinder is provided with additional packing, the form rollers must be adjusted manually by their separate adjusting mechanisms, which is a time consuming procedure.

It is, accordingly, an object of the present invention to provide means for automatically positioning the form rollers with respect to a plate on a plate cylinder which makes unnecessary the usual adjustment of form rollers when increasing the thickness of packing. It is a more specific object to provide means for automatically positioning the form rollers on a plate cylinder which takes into account both the movement of the plate cylinder axis toward the form roller and the change in spacing between the plate and the plate cylinder axis with the result that the spacial relationship between the form rollers and the plate is unaffected by a change in the thickness of the packing and unaffected by the accommodating change which must be made between the axes of the plate cylinder and the blanket cylinder when the packing is changed.

It is another object of the invention to provide a mechanism for simultaneously changing the positioning of a plurality of form rollers with respect to the axis of the associated printing cylinder by means of an extremely simple arrangement including a cam sector having a plurality of spirally curved segments rotatatively coupled to the eccentric bushing which mounts the plate cylinder, the spiral slope of the curved segments being such as to cause a total outward throw at each of the form rollers equal to the movement of the plate cylinder axis toward the form roller plus an amount equal to the added thickness of the packing to maintain a preset relationship between the form rollers and the plate over a wide range of packing thickness.

It is, accordingly, an object of the present invention to provide an automatic form roller positioning mechanism which is simple in construction and highly economical both in first cost and in terms of the "down time" usually required for individual roller adjustment when making a change in packing thickness. The mechanism, which achieves form roller adjustment automatically incident to adjusting the relationship between a plate cylinder and a cooperating cylinder such as a blanket cylinder, enables the total adjustment to be performed in a minimum of time by personnel having only limited skill and experience in press operation.

Other objects and advantages of the invention will become apparent upon reading the attached detailed description and upon reference to the drawings in which:

FIG. 1 is an elevational view of a form roller positioning mechanism looking along line 1—1 in FIG. 2.

FIG. 1*a* is a fragmentary view showing the shaft and eccentric bushing enlarged to show the locations of the center points.

While the invention has been described in connection with certain preferred embodiments, it will be understood that I do not intend to be limited to the particular embodiments shown, but intend, on the contrary, to cover the various alternative and equivalent constructions falling within the spirit and scope of the appended claims.

Figure 1:
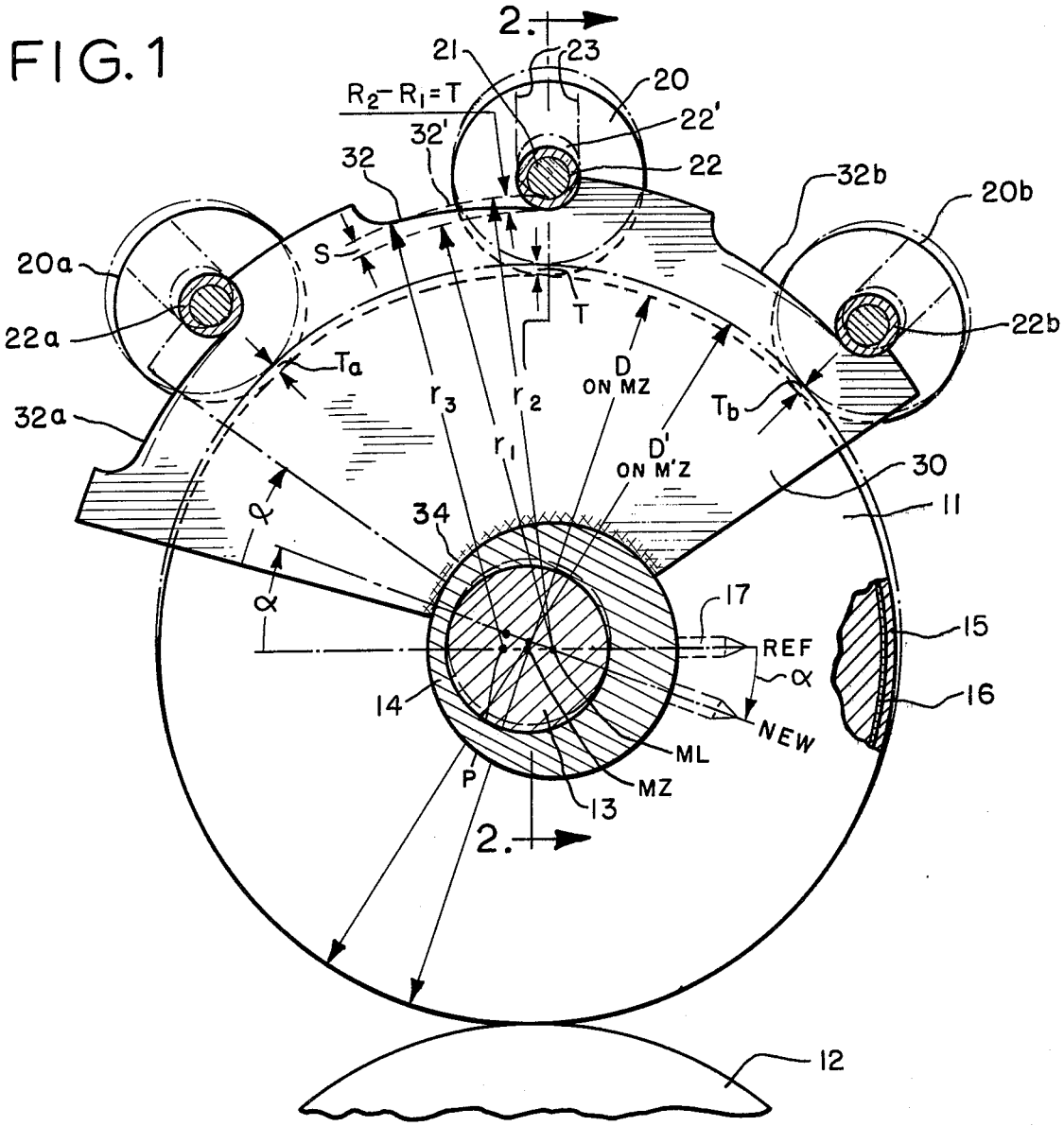
Figure 2:
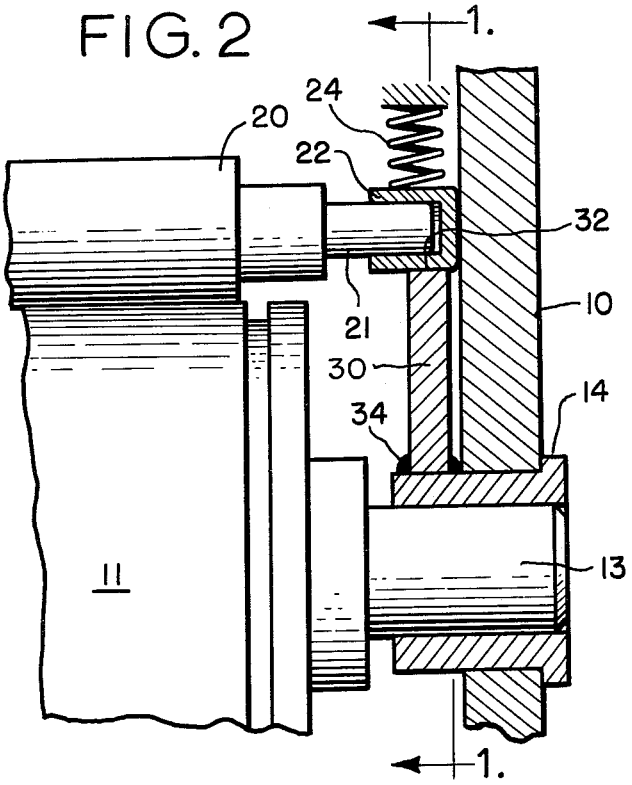
FIG. 2 is a fragmentary cross section looking along line 2—2 in FIG. 1.

Turning now to the drawings and particularly to FIGS. 1 and 2, there is shown a frame 10 of a printing press which, in the present embodiment, is of the lithographic type, having a plate cylinder 11 and a cooperative blanket cylinder 12. Both cylinders are journaled in the frame in the usual way, the plate cylinder 11 having a stub shaft 13 journaled in a bushing 14. Mounted upon the surface of the plate cylinder is a plate 15 having a layer of packing, or underlayment 16 which may, for example, be hard manila paper.

For the purpose of initially adjusting the relationship between the plate and the blanket cylinder establishing a desired running pressure between them, and for restoring this initial condition whenever it is necessary to make a change in the thickness of the packing, the bushing 14 is in the form of an eccentric having a center ML. The center of the eccentric is offset from the axis of the plate cylinder, indicated at MZ, by an amount of eccentricity *e*. An arm diagrammatically indicated (FIG. 1) at 17 is provided for rocking the eccentric bushing 14, the bushing being rocked in the direction of the arrow to achieve an increase in the spacing between the axes of the plate and blanket cylinders for the purpose of accommodating a thicker layer of packing 16. Such accommodation is well known in the art.

For the purpose of applying ink, or water, to the plate on the plate cylinder a series of rubber covered form rollers are provided. A typical form roller indicated at 20 has a shaft 21 received in a bearing 22. The bearing occupies a peripheral position around the plate cylinder which is substantially spaced from the cooperating cylinder 12 and is maintained in such peripheral position by any suitable means, for example a pair of way surfaces which are not shown but which have been diagrammatically illustrated, at 23, in FIG. 1. It will be understood that means, pressing upon the bearing 22, are provided for maintaining pressure between the form roller 20 and the plate on the plate cylinder, such means being diagrammatically illustrated in the form of a biasing spring 24 (FIG. 2).

In carrying out the invention in a practical way, more than one form roller will be used and such additional form rollers, and their associated parts, are indicated by similar reference numerals, with addition of subscript *a* for the left-hand form roller 20*a* and addition of subscript *b* for the right-hand form roller 20*b*. The means used to furnish ink, or water, to the form rollers has not been shown and will be understood to be conventional.

In accordance with the present invention a cam sector is mounted at the end of the plate cylinder having spirally curved segments for radially supporting the roller bearings with respect to the plate and mounted for rocking movement for camming the rollers relatively away from the axis of the plate cylinder, the cam sector being rotatively coupled to the eccentric bushing for rocking movement in unison therewith accompanied by relative wiping action between the curved segments and the respective roller bearings and the spiral slope of each of the curved segments being such that the degree of rocking of the eccentric bushing necessary to accommodate a predetermined increase in packing thickness causes a total outward throw at each of the form rollers equal to the movement of the plate cylinder axis toward the form roller plus an amount equal to the added thickness of the packing, with the result that the spacial relationship between the form rollers and the plate, and hence the pressure between the two, is unaffected by a change in the thickness of the packing. Thus I provide a cam sector 30 having a curved segment 32 which bears against the form roller bearing 22, acting to support the form roller bearing radially against the force of the biasing means 24. In the preferred embodiment of the invention the cam sector 30 is directly fixed, along its inner edge, to the eccentric bushing 14, the region of attachment being indicated at 34. Thus the cam sector undergoes rocking movement in unison with the rocking movement of the eccentric bushing, with the bushing axis ML as a center. Similar curved segments 32*a*, 32*b* are provided for supporting the bearings of the associated form rollers 20*a*, 20*b*, so that all of the form rollers are subject to simultaneous automatic positioning.

The manner in which the profiles of the curved segments 32 are determined in practicing the invention may be made clear by assuming that an initial, or reference, condition exists, plotting a step change in packing thickness, and then profiling the curved segments to achieve the resulting step change and roller position required to maintain the same roller-to-plate relationship which will, in turn, maintain the same roller pressure notwithstanding the change in packing thickness.

Thus it will be assumed, first of all, that the plate cylinder, with plate installed, has a reference diameter D. With the system adjusted for the running condition, a predetermined and desired pressure will exist between the plate cylinder and the blanket cylinder 12 by reason of the setting of the eccentric 14. Similarly a desired space and pressure relationship will be assumed to exist between the form rollers 20, 20*a* and 20*b* and the plate. For the sake of simplicity, the means for obtaining this initial adjustment of the form rollers has been omitted from the figures and preliminary description but such means will be discussed in a subsequent paragraph in connection with FIG. 6.

Let it next be assumed that the paper fed to the press has an unusually high moisture content requiring a slightly elongated printed image which will be reduced to normal size when the printed sheet subsequently dries out, and that such elongation is to be accomplished by an increase in the thickness of the packing 16. Normally such increase in amount of packing is only slight, the thickness of a few layers of manila paper; however, the change in packing thickness has been greatly magnified in FIG. 1 to clarify the explanation resulting in an increase in effective printing diameter from D to an amount D'. The increase in packing thickness results in increased pressure against the cooperating cylinder 12. To restore such pressure to running level the eccentric bushing 14 is rotated from its reference position through an angle $\alpha$ to a new position, thus increasing the spacing between the axes of the cylinders 11, 12, the angle $\alpha$ being of such magnitude as to restore the original running pressure. In the present instance this is assumed to be 20°, although the amount is continuously variable from 0°.

Since the sector plate 30 is fixed to the bushing 14, it also undergoes a rocking movement equal to $\alpha$, during the course of which bearing 22 of the form roller must be cammed outwardly from its original radius $r1$ from the center ML to a new radius $r2$. The radius $r2$ is determined by knowing that the difference between $r2$ and $r1$ required to restore the original relation between the form roller 20 and the plate surface at the increased diameter must be equal to the throw T at the peripheral location of the form roller. This total throw, which is different at each of the form roller locations results in a spiral slope S. Such spiral slope causes the curved segment 32 to "ascend" to a level 32', at a radius $r2$, as the sector plate is swung, through the assumed angle of 20°, to its new position in unison with the eccentric bushing.

Figure 1A:
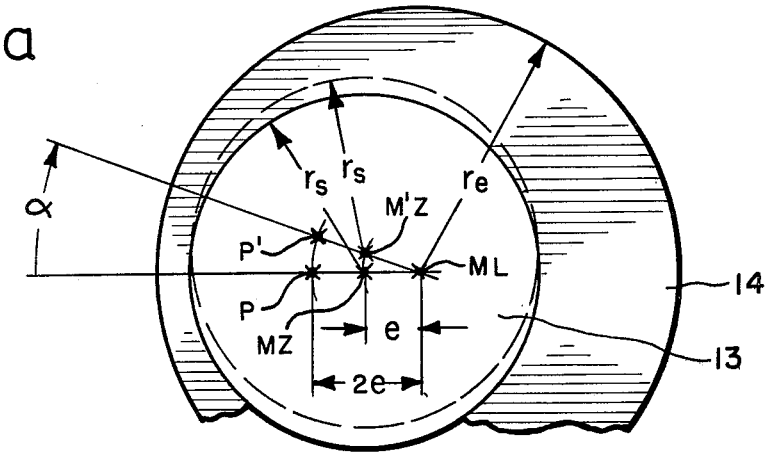

In accordance with one of the aspects of the present invention, the curved segment 32 lies substantially in the locus of a circle whose center P lies on a straight line interconnecting the plate cylinder axis MZ and the eccentric bushing axis ML, with the center P being spaced from the bushing axis by an amount which is twice as great as the spacing between the plate cylinder axis and the bushing axis. Thus, referring to FIG. 1*a*, where the spacing between the centers ML and MZ is an amount equal to the eccentricity $e$ of the eccentric, the point P is at a distance of $2e$ from the eccentric center. Thus to define the profile of the camming segment 32 it suffices to swing an arc at radius $r3$ from point P.

It will be helpful to note that where the cam sector 30 is fixedly secured to the eccentric bushing 14, the spiral slope S and hence the total ascent of the roller bearing 22 to the level 22', compensates for two components which are additive, the first being the movement of the plate cylinder axis toward the form roller and the second being the radial thickness of the added packing.

The net effect is that the spacial relationship between the form roller 20 and the plate, and the applied form roller pressure, once adjusted in an initial condition, remain the same regardless of the thickness of packing which may be thereafter employed. This is provided only that a plate of consistent thickness be used.

While the invention and its peculiar geometry have been described in connection with only the central form roller 20, it is one of the features of the invention that the same procedures are applicable for other form rollers such as 20*a*, 20*b* which are spaced therefrom, provided only that all of the form rollers are substantially spaced from the region of contact of the cooperating, in this case blanket, cylinder 12. Thus it is one of the surprising features of the invention that the curved segments 32*a*, 32*b*, while spaced from the segment 32, nevertheless lie substantially in the loci of circles centered about point P, and this fact may be conveniently utilized in the generation of such segments.

Figure 4:
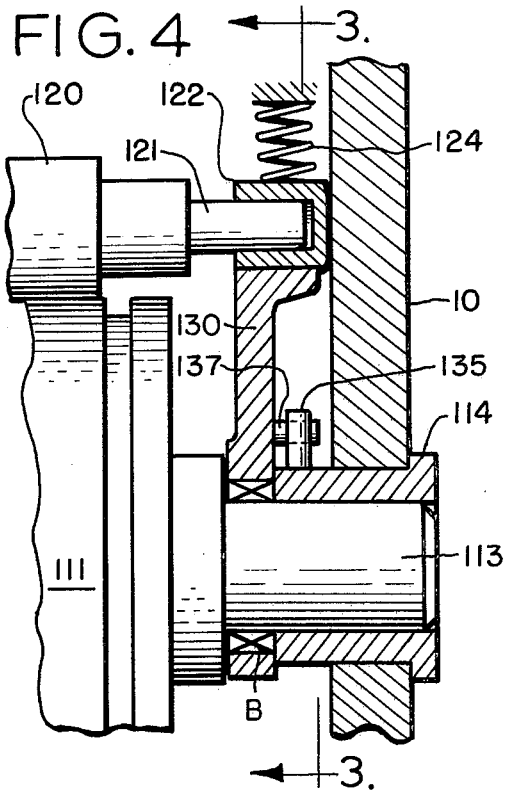
FIG. 4 is a fragmentary cross section taken along line 4—4 in FIG. 3.

While it is preferred to secure the cam sector fixedly to the eccentric bushing, this is not one of the essentials of the invention and the invention may be practiced by centering the cam sector about the plate cylinder axis and by providing rotative coupling between the cam sector and the bushing so that they undergo rocking movement in unison about different centers. Thus referring to the alternate embodiment illustrated in FIGS. 3 and 4, corresponding parts have been indicated by corresponding reference numerals plus 100. The plate cylinder 111 is mounted upon a stub shaft 113 which is journaled within an eccentric bushing 114. Riding on the surface of the plate cylinder are form rollers 120, 120*a*, 120*b* having bearings 122, 122*a*, 122*b*, respectively. It will be understood that the bearings are held in their respective peripheral positions by suitable guides or the like as in FIG. 1 and suitable means 124 are provided for biasing the bearings radially inwardly.

For supporting the bearings, and hence the rollers, in positions, with respect to the plate, providing a desired initial level of running force, a cam sector 130 is used which, in the present instance, is not fixed to the bushing but is, instead, centered for rocking movement about the shaft 113, an anti-friction bearing B being interposed. At the periphery of the cam sector 130, cam surfaces are provided in the form of curved segments 132, 132*a* and 132*b* for supporting the respective rollers. While the "throws" of the form rollers indicated at T', T*a*' and T*b*' to achieve compensation for added packing thickness are respectively the same as in the earlier embodiment and while the same total ascent of the form rollers is required, nevertheless it will be seen that the spiral slope S' is substantially less than in the earlier embodiment. The reason for this is that the form rollers, being effectively supported upon the plate cylinder axis, move with such axis when the eccentric is rocked. Thus there would be a partial throw of the form rollers due to the shift of the plate cylinder axis even in the lack of any spiral slope at the curved segments. Specifically, the spiral slope of the segments 132, and hence the ascent of the rollers by reason of the slope, may be limited, in the embodiments of FIGS. 3 and 4, to that component of the throw which is accounted for by the added thickness of the packing. In short, the component of throw brought about by the curved segments 132 is given by $r2 = r1 = PT$ where PT is equal to the added thickness of the packing and this is the same for all three of the curved segments.

For the purpose of rotatively coupling the cam sector 130 to the eccentric bushing 114 for rotation in unison around different centers, the eccentric bushing is, in an exemplary embodiment, provided with a radial pin 135 which is held captive between pins 136, 137 on the cam sector, although it will be apparent to one skilled in the art that any equivalent rotative coupling may be utilized for this purpose.

Figure 5:
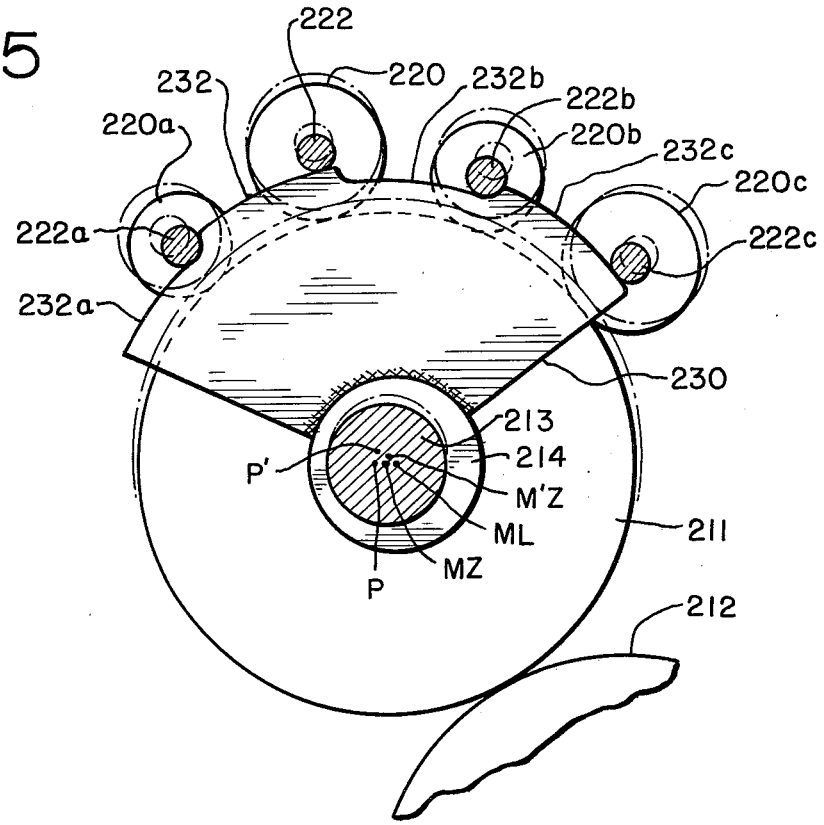
FIG. 5 is an elevational view showing a still further embodiment of the invention similar to FIG. 1 but utilizing form rollers of unlike diameter.

Although the form rollers utilized in the preceding embodiments are shown as being of the same size, and three in number, the invention is not limited thereto and may be employed with form rollers of different sizes and in different number as illustrated in FIG. 5. The structure in this figure closely resembles that of FIG. 1, and similar reference numerals have been employed, increased by 200. Thus the plate cylinder 211, in running contact with a cooperating cylinder 212, is supported upon a shaft 213 in an eccentric bushing 214. In rolling engagement with the surface of the plate are a set of form rollers 220–220*c* having bearings 222–222*c*. The form rollers 220 and 220*c* are, as will be noted, of substantially larger diameter than the remaining form rollers 220*a*, 220*b*.

For the purpose of camming the rollers outwardly when thicker packing is used, a cam sector 230 is employed providing respective curved segments 232–232*c* all of which lie substantially in the locus of circles having a center P. Since adjacent form rollers are of unlike diameter the segments are, however, in stepped configuration. The operation is, however, the same as that set forth in FIG. 1, and the centers of FIG. 1*a* and the sectional view, of FIG. 2, are applicable.

Figure 3:
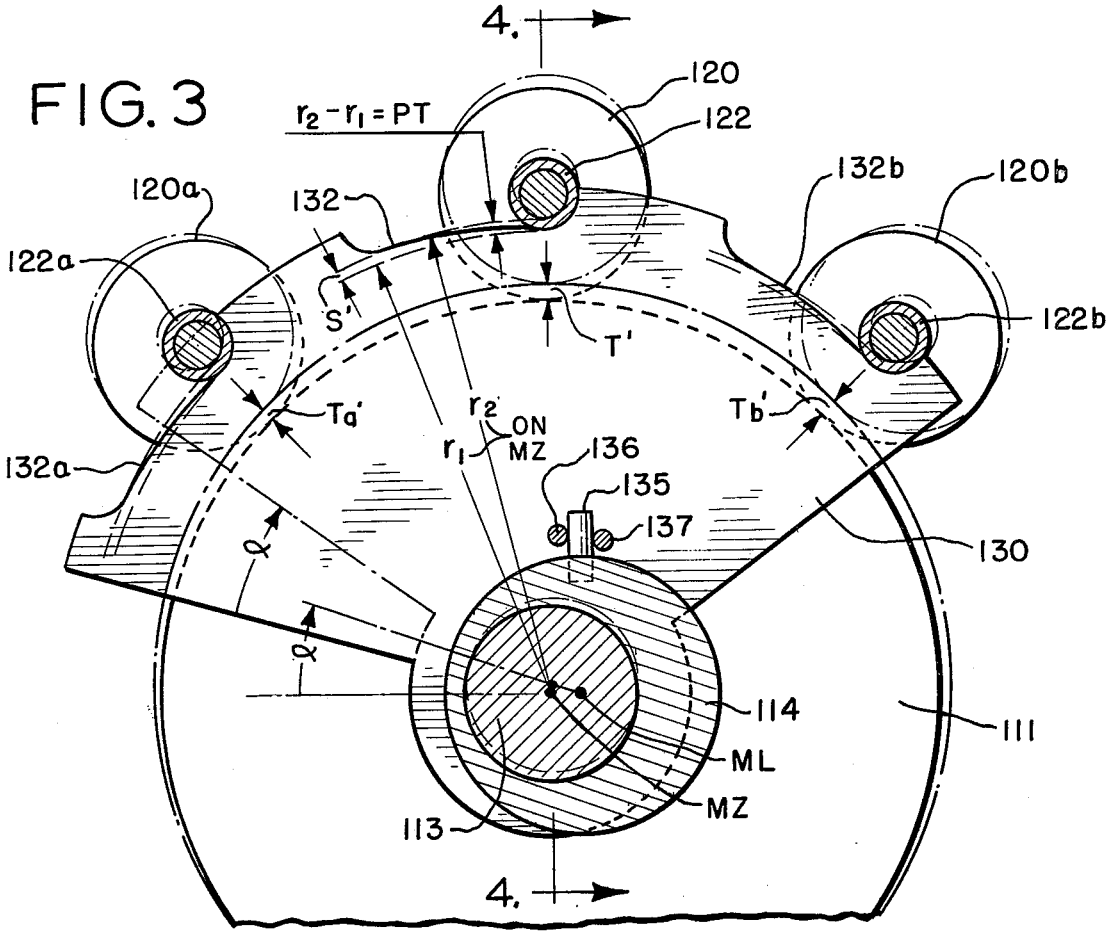
FIG. 3 is an elevational view similar to FIG. 1 but directed toward an alternate embodiment, looking along line 3—3 of FIG. 4.
Figure 6:
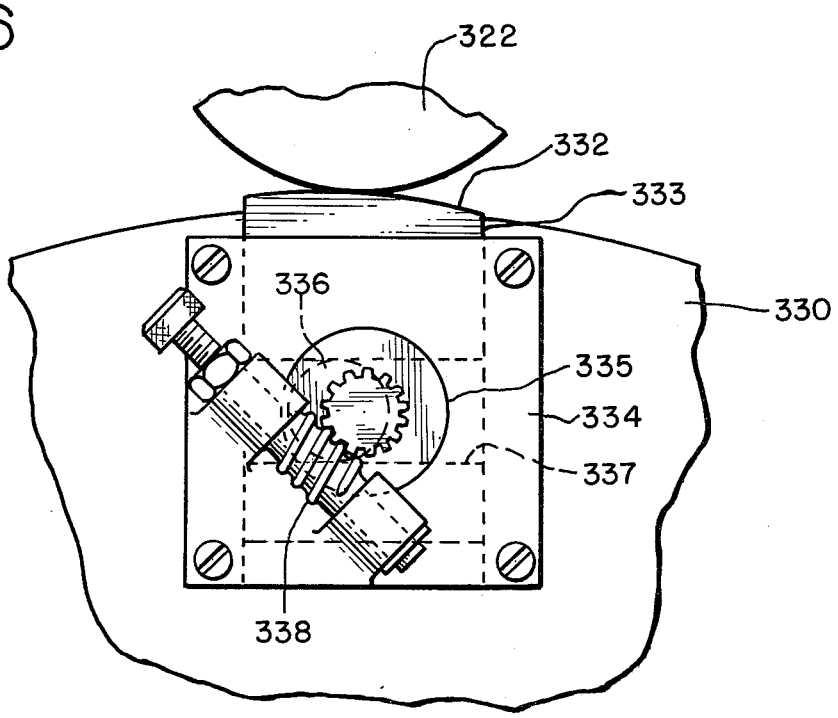
FIG. 6 is a fragmentary elevation showing means for adjusting the radial position of a curved segment on the cam sector.

In the description of the embodiments of the invention set forth above, it has been mentioned that in the reference condition of the structures set forth in FIGS. 1, 3 and 5 the forces between the plate and blanket cylinder and the plate and the form rollers are initially optimum. A possible means for obtaining this initially optimum condition is shown in FIG. 6 in which a typical curved segment is shown at 332 mounted upon a cam sector 330, and supporting the bearing 322 of the associated form roller. The curved segment 332 is formed on a slide 333 retained by a plate 334. Penetrating the plate is an eccentric element 335 having an eccentric crank, or pin, 336 engaging a transverse groove 337 in the slide. The eccentric element 335 is driven by a worm 338 having an associated worm wheel. Turning the worm in one direction or the other progressively increases or decreases the average or "working" radius of the curved segment 332 thereby making it possible to adjust the bearing 322 of the associated form roller to provide the proper initial degree of force between the form roller and the printing plate. While the use of a worm and worm wheel plus eccentric for adjustment purposes has the advantage of precision and accurate maintenance of setting, it will be apparent to one skilled in the art that the invention is not limited thereto and that any desired means may be provided for changing the working radius of the curved segment 332. Similar adjusting means may be used at each of the other segment positions. Note that while the working radius at each position is subject to adjustment, nonetheless all of the segments, just as in the embodiment of FIGS. 1 and 2, lie substantially in the locus of circles having the center P. Also while the segment 332 is shown in FIG. 6 as presenting a limited periphery, it will be apparent to one skilled in the art that the slide 333 may be peripherally widened to any desired degree without departing from the invention.

What I claim is:

1. In a printing press, the combination comprising a frame, a plate cylinder journaled in the frame and mounting a printing plate with a layer of packing interposed between the cylinder and the plate, a cooperating cylinder journaled in the frame running in engagement with the plate, the plate cylinder having at least one form roller having a bearing at a peripheral position substantially spaced from said cooperating cylinder, an eccentric bushing interposed between the plate cylinder and the frame rockable from a reference position t an adjusted position for increasing the spacing between the axes of the plate cylinder and its cooperating cylinder as necessary to accommodate an increase in the thickness of the packing, a cam sector rockably mounted at the end of the plate cylinder having a spirally curved segment for radially supporting the form roller bearing with respect to the plate and mounted for rocking movement for camming the roller relatively away from the axis of the plate cylinder, the cam sector being rotatively coupled to the eccentric bushing for rocking movement in unison therewith accompanied by relative wiping action between the curved segment and the roller bearing, the spiral slope of the curved segment being such that the degree of rocking of the eccentric bushing necessary to accommodate a predetermined increase in packing thickness causes a total outward throw at the form roller equal to the movement of the plate cylinder axis toward the form roller plus an amount equal to the added thickness of the packing.

2. In a printing press, the combination comprising a frame, a plate cylinder journaled in the frame and mounting a printing plate with a layer of packing interposed between the cylinder and the plate, a cooperating cylinder journaled in the frame running in engagement with the plate, the plate cylinder having at least one form roller having a bearing at a peripheral position substantially spaced from the said cooperating cylinder, an eccentric bushing interposed between the plate cylinder and the frame rockable from a reference position to an adjusted position for increasing the spacing between the axes of the plate cylinder and its cooperating cylinder as necessary to accommodate an increase in the thickness of the packing, a cam sector rockably mounted at the end of the plate cylinder and having a spirally curved segment for radially supporting the roller with respect to the plate, the cam sector being rigid with the eccentric and movable therewith to produce relative wiping movement between the curved segment and the roller bearing for camming the roller relatively away from the axis of the plate cylinder, the spiral slope of the curved segment being such that the degree of rocking of the eccentric bushing necessary to accommodate a predetermined increase in packing thickness causes a total outward throw at the form roller equal to the movement of the plate cylinder axis toward the form roller plus an amount equal to the added thickness of the packing.

3. The combination as claimed in claim 2 in which the curved segment lies substantially in the locus of a circle whose center P lies on a straight line interconnecting the plate cylinder axis and the eccentric bushing axis, with the center P being spaced from the bushing axis by an amount which is twice as great as the spacing between the plate cylinder axis and the bushing axis.

4. In a printing press, the combination comprising a frame, a plate cylinder journaled in the frame and mounting a printing plate with a layer of packing interposed between the cylinder and the plate, a cooperating cylinder journaled in the frame in running engagement with the plate, the plate cylinder having a plurality of form rollers having respective bearings at peripheral positions spaced from one another and all of which are substantially spaced from the said cooperating cylinder, and eccentric bushing interposed between the plate cylinder and the frame rockable from a reference position to an adjusted position for increasing the spacing between the axes of the plate cylinder and its cooperating cylinder as necessary to accommodate an increase in the thickness of the packing, a cam sector rockably mounted at the end of the plate cylinder having spirally curved segments for radially supporting the roller bearings with respect to the plate and mounted for rocking movement for camming the rollers relatively away from the axis of the plate cylinder, the cam sector being rotatively coupled to the eccentric bushing for rocking movement in unison therewith accompanied by relative wiping action between the curved segments and the respective roller bearings, the spiral slope of each of the curved segments being such that the degree of rocking of the eccentric bushing necessary to accommodate a predetermined increase in packing thickness causes a total outward throw at each of the form rollers equal to the movement of the plate cylinder axis toward the form roller plus an amount equal to the added thickness of the packing and the curved segments having a common center with the result that the spacial relationship between the form rollers and the plate is unaffected by a change in the thickness of the packing.

5. In a printing press, the combination comprising a frame, a plate cylinder journaled in the frame and mounting a printing plate with a layer of packing interposed between the cylinder and the plate, a cooperating cylinder journaled in the frame running in engagement with the plate, the plate cylinder having a plurality of form rollers having respective bearings at peripheral positions spaced from one another and all of which are substantially spaced from the said cooperating cylinder, an eccentric bushing interposed between the plate cylinder and the frame rockable from a reference position to an adjusted position for increasing the spacing between the axes of the plate cylinder and its cooperating cylinder as necessary to accommodate an increase in the thickness of the packing, a cam sector fixed to the eccentric bushing for rocking movement in unison therewith, the cam sector having a plurality of spirally curved segments for radially supporting the roller bearings with respect to the plate and mounted for rocking movement for camming the rollers relatively away from the axis of the plate cylinder, the spiral slope of the respective curved segments being such that the degree of rocking of the eccentric bushing necessary to accommodate a predetermined increase in packing thickness causes a total outward throw at each of the form rollers equal to the movement of the plate cylinder axis toward the form roller plus an amount equal to the added thickness of the packing, with the result that the spacial relationship between the form rollers and the plate is unaffected by a change in the thickness of the packing, the curved segments lying respectively in the loci of circles having a common center P lying on a straight line interconnecting the plate cylinder axis and the eccentric bushing axis, with the center P being spaced from the bushing axis by an amount which is twice as great as the spacing between the plate cylinder axis and the bushing axis.

6. The combination as claimed in claim 4 in which means are interposed between each of the curved segments and the cam sector for individual adjustment of the radial position of each curved segment for determining the initial spacial relationship between the form rollers and plate using an initial thickness of packing.

7. The combination as claimed in claim 6 in which each position adjustment means is in the form of an eccentric driven by a worm and worm wheel.

* * * * *